US008087215B2

(12) United States Patent
Koelker et al.

(10) Patent No.: US 8,087,215 B2
(45) Date of Patent: Jan. 3, 2012

(54) FORMING, FILLING AND SEALING MACHINE, AND METHODS FOR PRODUCING, FILING AND CLOSING BAGS

(75) Inventors: Martin Koelker, Ibbenbueren (DE); Ludger Schulten, Hopsten (DE); Thomas Knoke, Bielefeld (DE); Ulrich Stienecker, Ladbergen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 363 days.

(21) Appl. No.: 12/227,173

(22) PCT Filed: Apr. 26, 2007

(86) PCT No.: PCT/EP2007/054123

§ 371 (c)(1),
(2), (4) Date: Nov. 10, 2008

(87) PCT Pub. No.: WO2007/131870

PCT Pub. Date: Nov. 22, 2007

(65) Prior Publication Data

US 2009/0308028 A1 Dec. 17, 2009

(30) Foreign Application Priority Data

May 12, 2006 (DE) ..... 10 2006 022 709

(51) Int. Cl.
*B65B 9/02* (2006.01)

(52) U.S. Cl. ..... 53/450; 53/452; 53/550; 53/503; 53/75

(58) Field of Classification Search ..... 53/450–453, 53/455, 545, 550–551, 553–555, 52, 503, 53/75

See application file for complete search history.

(56) References Cited

U.S. PATENT DOCUMENTS

| | | | | |
|---|---|---|---|---|
| 3,442,061 | A | 5/1969 | Grafingholt et al. | |
| 4,037,387 | A | 7/1977 | Orikawa | |
| 4,730,439 | A | 3/1988 | Chung et al. | |
| 4,918,906 | A | 4/1990 | Ako | |
| 5,528,883 | A | 6/1996 | Jamison | |
| 6,401,439 | B1 | 6/2002 | Tetenborg et al. | |
| 6,460,317 | B1 | 10/2002 | Voss | |
| 6,474,050 | B1 | 11/2002 | Tetenborg | |
| 6,688,080 | B2 * | 2/2004 | Kinigakis et al. | 53/412 |
| 7,877,966 | B2 * | 2/2011 | Knoke et al. | 53/469 |
| 2008/0257450 | A1 | 10/2008 | Combrink | |

FOREIGN PATENT DOCUMENTS

| | | |
|---|---|---|
| DE | 1 963 356 U | 6/1967 |
| DE | 25 35 932 | 4/1976 |
| DE | 26 45 810 A1 | 4/1978 |
| DE | 34 16 557 A1 | 11/1985 |
| DE | 39 25 577 A1 | 2/1990 |

(Continued)

*Primary Examiner* — Christopher Harmon
(74) *Attorney, Agent, or Firm* — Jacobson Holman PLLC

(57) ABSTRACT

A forming, filling and sealing machine for producing bags from semifinished products, and for filling and closing the bags, includes a plurality of processing stations. At least two processing stations of at least one first group are successively, largely linearly, arranged in the horizontal plane (x, z) in the transport direction (z) of the bags. The bags or semifinished products are transported between the processing stations by transport devices which generally include gripping devices. The machine also includes at least one second group having at least one processing station that is not linearly arranged behind the first group in the horizontal plane (x, z) in the processing direction (z) of the bags.

14 Claims, 5 Drawing Sheets

FOREIGN PATENT DOCUMENTS

| | | | |
|---|---|---|---|
| DE | 197 08 596 | C1 | 6/1998 |
| DE | 199 20 478 | A1 | 11/2000 |
| EP | 0 283 297 | A2 | 9/1988 |
| EP | 1 050 458 | A1 | 11/2000 |
| EP | 1 201 539 | A1 | 5/2002 |
| EP | 1 459 981 | A1 | 9/2004 |
| GB | 1 268 170 | | 3/1972 |
| GB | 1 585 703 | | 3/1981 |
| GB | 2 222 564 | A | 3/1990 |
| WO | WO 2005/110849 | A2 | 11/2005 |

* cited by examiner

FORMING, FILLING AND SEALING MACHINE, AND METHODS FOR PRODUCING, FILING AND CLOSING BAGS

CROSS-REFERENCE TO RELATED APPLICATION

This is a national stage of PCT/EP2007/054123 filed Apr. 26, 2007 and published in German, which has a priority of German No. 10 2006 022 709.3 filed May 12, 2006, hereby incorporated by reference.

BACKGROUND OF THE INVENTION

1. Field of Invention

The present invention relates to a form, fill, and seal machine and a method for producing, filling, and closing bags.

2. Description of the Prior Art

Machines of this type are known from the prior art and are used in various sectors of technology. These machines are used to "Form," "Fill," and "Seal" bags. The term FFS for "Form, Fill, and Seal machine" has thus also made way into the German language area with reference to these machines.

Efficient and automated versions of these machines, in particular, unwind a plastic tube from an unwinding station, perform a cross-welding process on the same, separate the tube provided with cross-welding to form bags (=tube piece with cross-welding), open the bag, fill the bag with a filling pipe comprising fill material, close the bag, provide the sealed bag opening with another cross-welding sealing the bag, and place the finished, filled bag on a suitable pallet or a transport means such as a conveyor belt.

Independent processing stations are often assigned to each of or at least a plurality of the processing steps mentioned above. Suitable transport means are to be provided in this case. If the unwinding process is considered to be a processing station, then the transport means, using which the tube is brought from the unwinding station to the cross-welding and separating station, usually comprise typical tube-transporting means such as guide rollers. Following the separation of the bags, relatively more nonstandard transport means, which usually comprise gripping means, are required since the bags, as a rule, are to be grasped at their ends, still open, and transported. The sealed end of the bag usually hangs down. Individual grippers or pairs of grippers are usually used as gripping means.

A machine of this type has been disclosed in EP 1 201 539 B1 for example. The manner, in which bags or semi-finished goods are transported or produced in the machine illustrated in this document, the sequence of the individual processing stations and the manner, in which bags are produced, filled, and sealed in this machine, are essential for understanding the present document and are incorporated by reference herein.

Reduction of the maintenance and operating costs of a machine of this type is an ever-persisting task of the machine designer and also forms the basis of the present invention.

It has been shown that the ability to operate and maintain a machine of this type comprising linearly successively disposed processing stations can be expanded.

SUMMARY OF THE INVENTION

The object of the present invention is therefore achieved by virtue of the fact that at least one second group comprising at least one processing station is not linearly disposed behind the first group (comprising linearly successively disposed processing stations) in the horizontal plane (x, z) in the processing direction (z) of the bags (1).

In this case, there is an increase in particularly the accessibility of the processing stations, which are directly adjacent to the "bend" or the cross-transport means, which interrupt the straight transport line to a certain extent.

This interruption of the straight transport line is particularly useful if a second group comprising more than one processing station follows the first linearly disposed group of processing stations and the point of interruption of the "straight line." This increases the accessibility of a plurality of processing stations. A straight arrangement of processing stations can again prevail within this second group.

There are advantages if the interruption of the straight transport line is carried out by a cross-transport, which takes place substantially perpendicularly to the previous linear transport. However, other angles are also feasible and they are included in the definition of cross-transport within the meaning of this application since a change in the transport direction by 30° by way of example naturally also results in a cross-transport containing cross components in the vectoral sense.

The word "cross-transport" is meant to connote the transport of bags or bag components and semi-finished goods (these terms are also often used interchangeably in the present application and the term "bags" often includes the two other terms) between the processing stations. The word "cross-transport" does not refer to the transport of entire processing stations. Transport of entire processing stations can naturally also result in the transport and cross-transport of bags present in the respective processing station relative to the machine frame. This is not the transport denoted by the term "cross-transport" here. Due to the weight of filling stations, in particular, the transport of the latter has not proved to be of value.

The present application is based on primarily stationary processing stations and the "bag transport" is understood to mean the delivery of bags from one processing station to the next. The at least one group can again be connected to the cross-transport means at a 90° angle.

The choice of words in the term "at least one second group" naturally indicates that at least two, three or four such second groups are also intended, thus suggesting a modular structure of the first and second groups. A plurality of second groups is especially advantageous if it contains processing stations, the operating speed of which is slower than that of the processing stations in the first group. Such a distinct difference in the operating speed results, for example, when filling dusty goods, between the filling station and the stations disposed upstream thereof since the dusty goods reduce the possible filling speed. Examples of dusty goods are cement and titanium dioxide. When these substances fall freely from the filling element to the bottom of the bag, they form such large quantities of dust that the cleanliness of the machine hall, functionality of the machine, and especially the ability to weld the film in the region of the bag opening are affected considerably. The air residue in the filled and sealed bag also poses a problem in the case of these fill materials.

Different measures for reducing the dust and air entrainment in the fill materials are therefore considered, which are partly also mentioned in EP 1 459 981 A1:

- a screw conveyor for conveying dusty goods in a bag,
- lifting means for changing the relative distance between the bottom of a bag to be filled and the outlet opening of the conveying means,
- control means, which control the distance between the outlet opening of the conveying means and the fill level of the bag during the filling process, suction means, which extract air from the bag during and/or after the filling process, vibrating equipment, which shakes the bag during and/or after the filling process.

At least one portion of these measures reduces the filling speed considerably as compared to a device such as the one illustrated in the afore-mentioned EP 1 201 539 B1 incorporated herein by reference.

It is therefore advantageous to provide several filling stations in a machine. Against the background of the present invention, the linear transport could therefore be interrupted after the cross-welding or separating station. After the filling of the bags, the bags filled by a plurality of filling stations could again be supplied to common processing stations. The bags could thus be sealed and welded either by common stations or stations assigned individually to the filling stations.

It has also been seen that an intermediate or transfer station can be arranged profitably in connection with cross-transport and for reasons of the operating speed. Such a station has gripping means and holds the bag usually during a fraction of a machine cycle. It can be arranged in front of or after the cross-transport means. These grippers also can execute movements in the bag-transport direction.

Additional exemplary embodiments of the invention are based on the description of the physical embodiments and the claims.

DETAILED DESCRIPTION OF THE PREFERRED EMBODIMENTS

Figure 2:
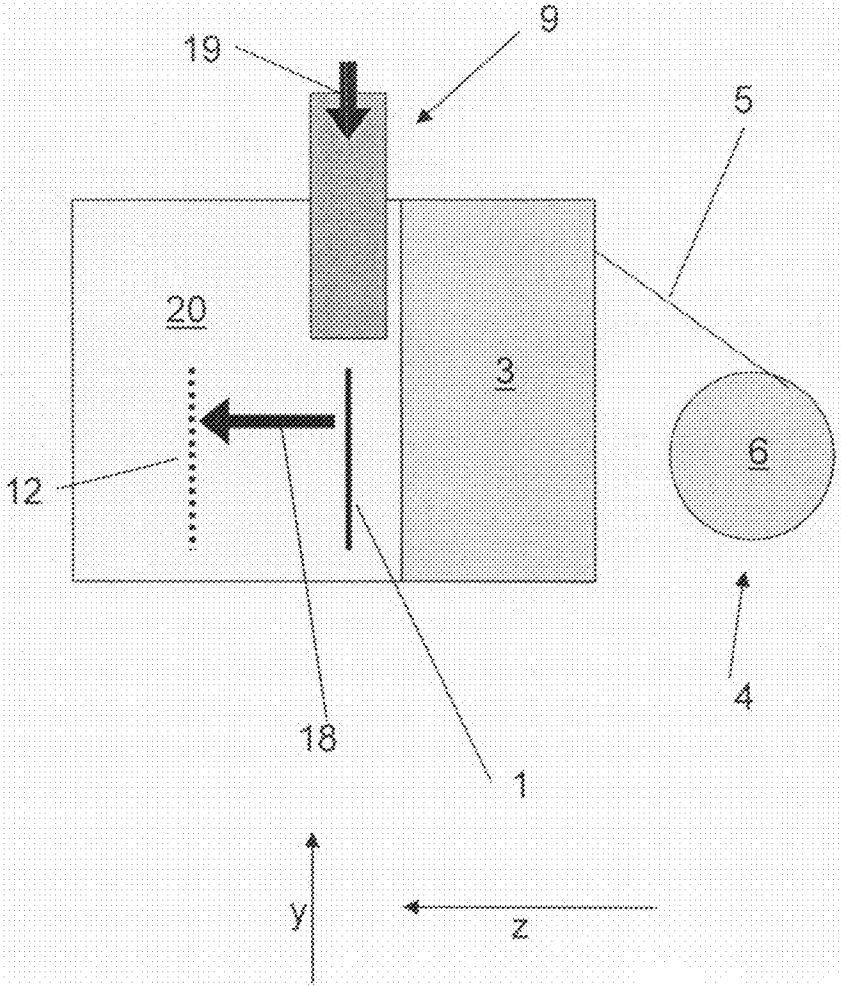
FIG. 2 is a lateral view of a first exemplary embodiment of the machine of the invention

Further scope of applicability of the present invention will become apparent from the detailed description given hereinafter. However, it should be understood that the detailed description of the specific examples, while indicating preferred embodiments of the invention, are given by way of illustration only, since various changes and modifications within the spirit and scope of the invention will become apparent to those skilled in the art from this detailed description.

FIGS. 1 to 4 and 7 show sketches of the machines 2 of the invention, in which the transport means 6, 10, 11, 12, 21, 22 and the individual processing stations 4, 7, 9, 12, 13 are merely illustrated in a stylized form. A more detailed description of these components is provided in EP 1 201 539 B1 cited several times above and incorporated by reference herein, EP 1 459 981 A1, and U.S. Pat. No. 6,401,439, which have likewise been mentioned above and include a more meticulous description and figures in this regard.

This note also applies, in particular, with regard to the grippers and gripper pairs 10, 11 and the manner and direction (above all z) in which they 10, 11 transport the bags 1 through the machine 2. The related passages of EP 1 201 539 B1 are expressly incorporated by reference in the scope of the present document. The decisive factor for the transport of the bags in modern machines is the reliable cyclical delivery of the already separated bags (=tube piece with bottom seam) from station to station using the afore-mentioned gripping means 10, 11 or 21, 22. The gripping means usually accomplish a linear transport in the transport direction z (except naturally cross-transport in the x direction). In modern machines such as the one described in EP 1 201 539 B1, the grippers or gripper pairs 10, 11 grasp the bag opening at the ends thereof. When tightening the bag opening, the bag walls come into contact with each other and in doing so, they form a right angle with the transport direction z; that is to say, they are oriented in the x direction.

The same also applies to the conveying direction (z) and the orientation of the walls of the tube 5 (in the x direction) after and during the unwinding process.

Figure 1:
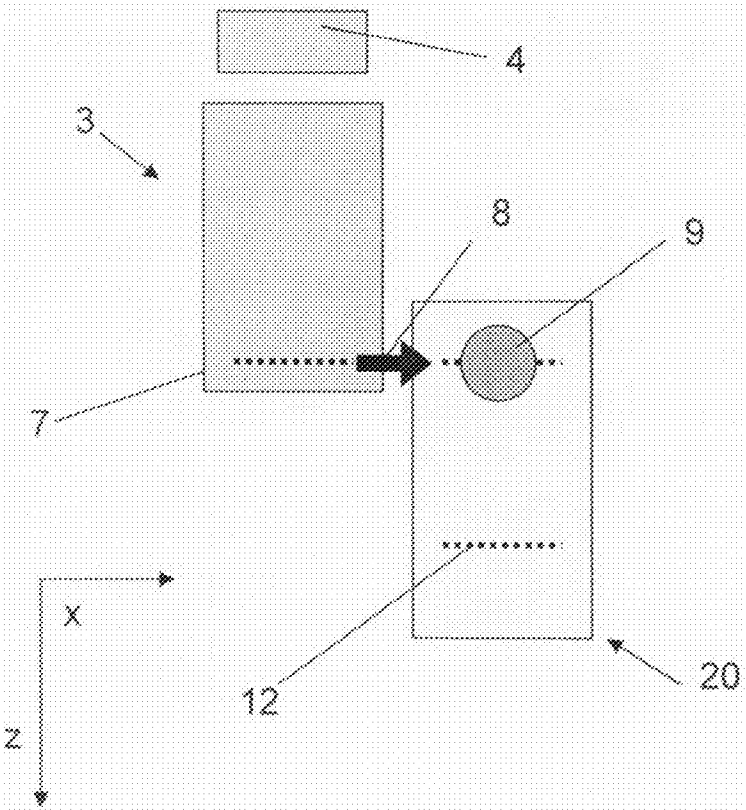
FIG. 1 is a plan view of a first exemplary embodiment of the machine of the invention

FIGS. 1 and 2 aim, in particular, to point out the sequence of the processing stations.

After the unwinding process at the unwinding station 4, in which a plastic tube 5 is unwound from a roll 6, a cross-welding is performed on the tube 5 and the latter is separated by a cross-separating cut. The last two processing steps take place in the cross-welding and separating station 7.

The cross-transport then takes place with the help of gripping means, which can also implement a movement in the x direction. The grippers are merely outlined by the arrow 8 in the figure. Following the cross-transport, the tube 5 arrives into the filling station 9, in which the bags 1 are filled.

Then, the bags are sealed in the sealing station 12, in which a top seam of the bag is usually formed by another cross-welding process. The sketches 3 and 4 show an alternative structure of an FFS machine, in which an intermediate or transfer station 13 is provided between the cross-separating station 7 and the filling station 9. In the case illustrated, the intermediate or transfer station 13 is assigned to the second group of processing stations 9, 12, which are disposed just as the first group of processing stations 4, 7, linearly successively in the horizontal plane formed here by the x and z coordinates in the transport direction z of the bags. In the two exemplary embodiments illustrated, the first group of processing stations 4, 7 thus contains components 4, 7, which are also collectively referred to as bag-making section 3 and which produce bags that are open toward the top.

Additional processing stations such as a vibrating station for compacting the fill material and/or a conveyor belt for the further transport and support of the filled bags by way of example are not shown in the figures, but can be regarded as processing stations within the meaning of the present application.

Figure 6:
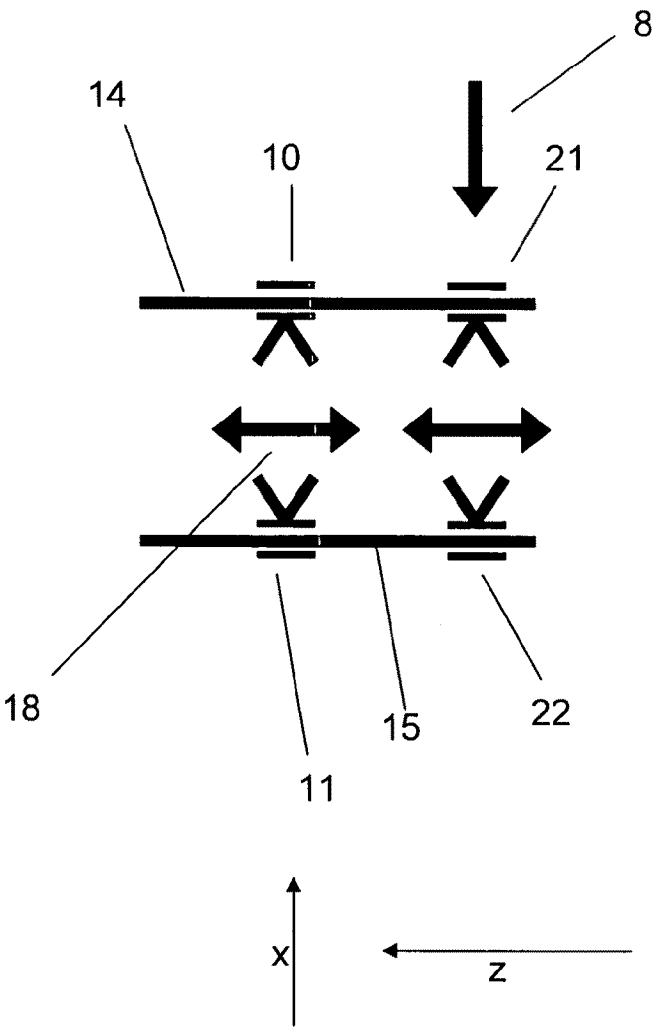
FIG. 6 shows the longitudinal transport using grippers in the second exemplary embodiment comprising an intermediate station
Figure 5:
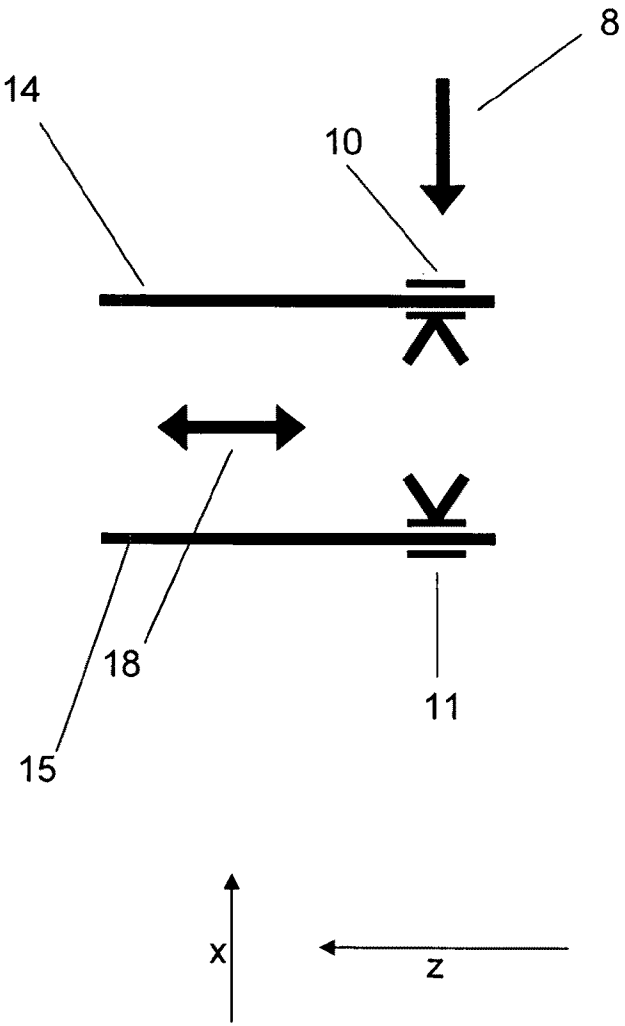
FIG. 5 shows the longitudinal transport using grippers in the first exemplary embodiment

Grippers 10 and 11 are shown in FIGS. 5 and 6 to clarify the function of the intermediate station. The grippers 10, 11 are transport means, which hold the bags 1 in the region of the filling station 9 and transport them further. The bags are thus supplied to the filling station 9 by the cross-transport device symbolized by the arrow 8 in FIG. 5. For this purpose, the latter comprises suitable gripping means (not illustrated), which perform the cross-transport of the bags in the x direction.

Another exemplary embodiment comprising an intermediate station 13 is shown in FIG. 6. Here, the cross-transport device 8 initially delivers the bags 1 to the pair of grippers 21 and 22. These two grippers then transport the bags 1 in the bag-transport direction z, which is also indicated here by the arrows 18. As a result of transport by this pair of grippers 21, 22, the bags 1 reach the region of the filling station 9, in which the other pair of grippers 10, 11 again transport the bags 1 further in the same manner as illustrated in FIG. 5.

Figure 8:
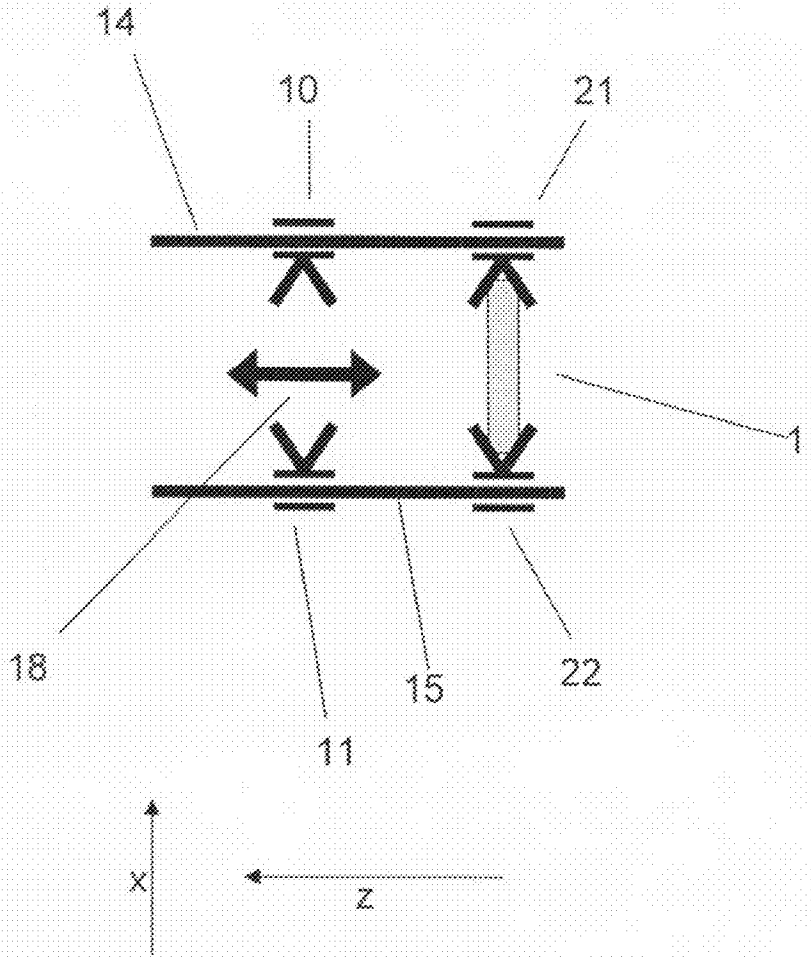
FIG. 8 shows the longitudinal transport using grippers in the second exemplary embodiment comprising an intermediate station for illustrating the orientation of the bags during their transport

As mentioned already a number of times previously, one characteristic of the transport of bags 1 or bag components in modern FFS machines, such as those illustrated in EP 1 201 539 B1, is the use of pairs of grippers or even individual grippers 10, 11, 21, 22, which transport bags in the manner shown in FIG. 8:

In such machines (such as those disclosed in EP 1 201 539 B1), the grippers or pairs of grippers 10, 11 grasp the bag opening at the ends 23, 24 thereof. When tightening the bag opening, the bag walls 25, 26 come into contact with each other and form a right angle with the transport direction z and extend along the x direction.

Figure 9:
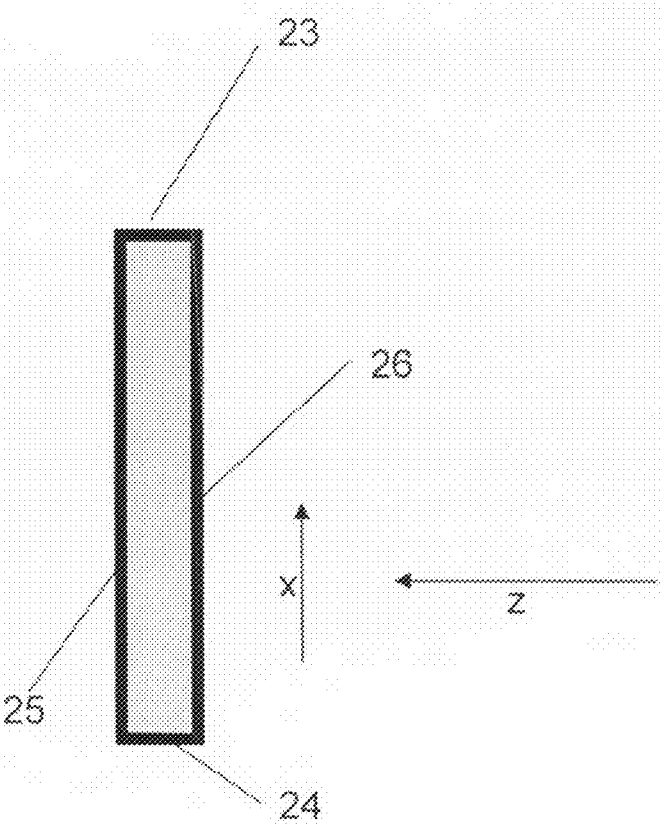
FIG. 9 is a plan view of a "tightened" bag opening.

FIG. 9 once again explains the significance of the last-mentioned terms with the help of a plan view of a "tightened" bag opening. FIG. 9 does not show the contact between the two bag walls 24 and 25 for visual reasons. But it is evident from the figure that the bag walls are oriented in the x direction in this transport situation, while the bag is transported in the z direction.

Machines are also known from the prior art, in which the function of a pair of grippers is performed by an individual gripper and in which the transport of the bags 1 in the transport direction z and their orientation during the transport is the same.

Figure 3:
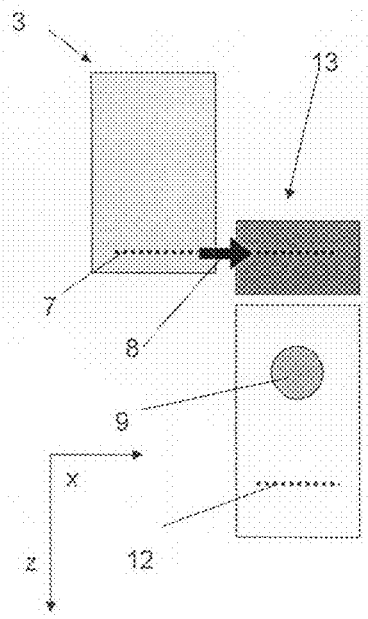
FIG. 3 is a plan view of a second exemplary embodiment of the machine of the invention comprising an intermediate station
Figure 4:
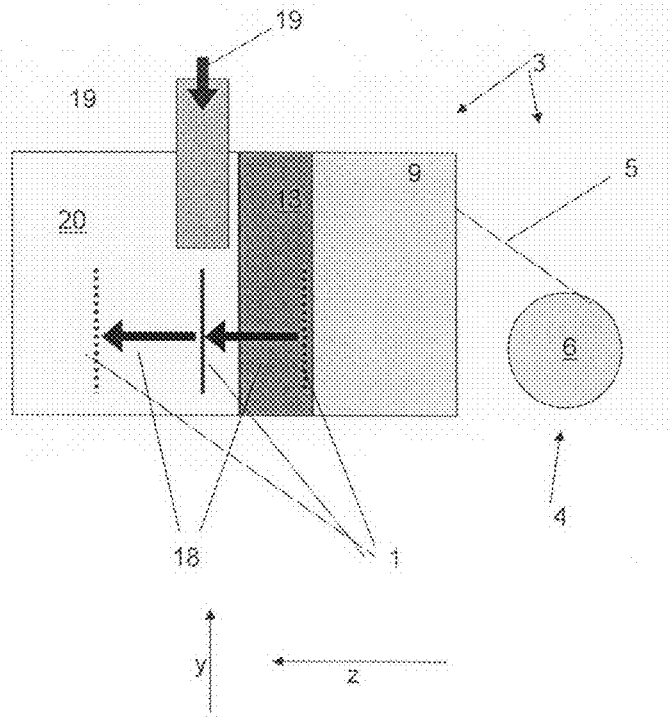
FIG. 4 is a lateral view of a second exemplary embodiment of the machine of the invention comprising an intermediate station
Figure 7:
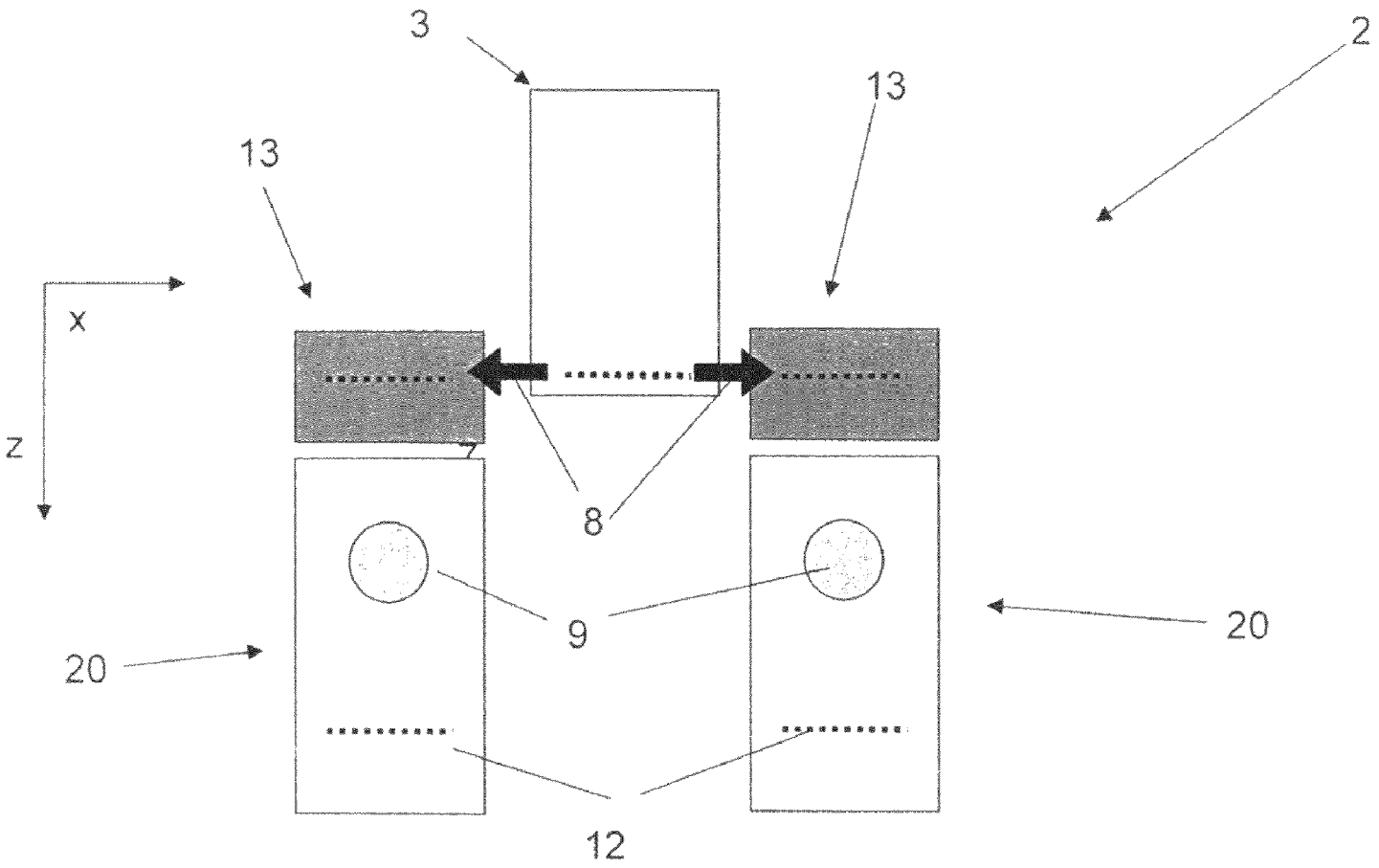
FIG. 7 is a plan view of a third exemplary embodiment of the machine of the invention comprising two second groups of processing stations, each of which comprises an intermediate station

FIG. 7 substantially shows a machine 2 according to the invention, which is designed corresponding to the exemplary embodiment shown in FIGS. 3 and 4. In particular, an intermediate station 13 is assigned to the bag-filling and closing section 20, which contains the filling station 9 and the sealing station 12 and forms the first second group of processing stations here. The machine 2 in FIG. 7 has two such bag-filling and closing sections 20. These sections can also be designed in a laterally reversed manner (in relation to the longitudinal axis of the machine 2). The advantages of a modular structure of the bag-making section 3 and the bag-filling and closing section 20 are obvious in this context.

Bags can thus be filled simultaneously or alternatively in the two filling stations 9. As a rule, it will be advantageous if the filling processes of the bags 1 in the two filling stations 9 overlap in terms of time.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| | List of reference numerals |
|---|---|
| 1 | Bags |
| 2 | Machine |
| 3 | Bag-making section |
| 4 | Unwinding station |
| 5 | Tube |
| 6 | Tube roll |
| 7 | Cross-welding and separating station |
| 8 | Cross-transport |
| 9 | Filling station |
| 10 | Gripper |
| 11 | Gripper |
| 12 | Sealing station |
| 13 | Intermediate or transfer station |
| 14 | Guide rod of the gripper 10 |
| 15 | Guide rod of the gripper 11 |
| 16 | One second group of processing stations |
| 17 | Another second group of processing stations |
| 18 | Arrow in the longitudinal transport direction |
| 19 | Arrow for indicating the flow of material |
| 20 | Bag-filling and closing section |
| 21 | Gripper |
| 22 | Gripper |
| 23 | Bag end |
| 24 | Bag end |
| 25 | Bag wall |
| 26 | Bag wall |
| x | Cross-transport direction of the bags 1 |
| y | Vertical direction |
| z | Longitudinal transport direction of the bags 1 |

What is claimed is:

1. A form, fill, and seal machine for producing bags from semi-finished products and for filling and closing the bags, comprising:

a plurality of processing stations, with at least two processing stations of at least one first group being disposed successively, substantially linearly in a horizontal plane (x, z) in a transport direction (z) of the bags, and with the bags or semi-finished products being transported between the processing stations by a transport device which includes grippers;

at least one second group including at least one processing station that is not linearly disposed in line with the first group in the horizontal plane (x, z) in the processing direction (z) of the bags;

a transverse transport device for transporting the bags to the at least one second group, the transverse transport device including grippers for transporting the bags in a direction lateral to that of the first transport direction (z); and an intermediate or transfer station arranged upstream or downstream of the transverse transport device, the intermediate or transfer station including grippers for holding and transporting the bags.

2. The form, fill, and seal machine according to claim 1, wherein the at least one second group includes at least two of the processing stations.

3. The form, fill, and seal machine according to claim 2, wherein the processing stations of the second group are disposed successively, largely linearly in the horizontal plane (x, z).

4. The form, fill, and seal machine according to claim 2, wherein a straight line defined by the first group of processing stations proceeds substantially parallel to a straight line defined by the second group of processing stations.

5. The form, fill, and seal machine according to claim 1, wherein the machine includes two of the second groups of processing stations.

6. The form, fill, and seal machine according to claim 1, wherein one of the processing stations welds a bottom seam and is a part of the first group of processing stations, and another one of the processing stations is a filling station and is a part of the second group of processing stations.

7. The form, fill, and seal machine according to claim 6, wherein the intermediate or transfer station is disposed between the processing station that welds the bottom seam and the filling station.

8. The form, fill, and seal machine according to claim 1, wherein the at least one second group of processing stations includes the intermediate or transfer station.

9. The form, fill, and seal machine according to claim 1, wherein the at least one second group of processing stations includes at least one of a screw conveyor for conveying dusty goods in the bag, a lifting device for changing a relative distance between a bottom of the bag to be filled and an outlet opening of the conveyor, a control device for controlling a distance between the outlet opening of the conveyor and a fill level of the bag during a filling process, a suction device for extracting air from the bag at least one of during and after the filling process, and vibrating equipment for shaking the bag at least one of during and after the filling process.

10. The form, fill, and seal machine according to claim 1, wherein the grippers grasp an upwardly oriented opening of the bags or semi-finished products and transport the bags or semi-finished products at least one of between and in a section of the processing stations of one group of processing stations such joined bag walls in a region of the opening form a substantially right angle with the transport direction (z) of the bags.

11. A method of producing bags from semi-finished products and of filling the bags, comprising performing steps of the method at a plurality of processing stations in a first group and a second group, with the bags or semi-finished products being transported substantially linearly between the processing stations in a horizontal plane (x, z) in a processing direction (z) of the bags or semi-finished products, and with the bags or semi-finished products being transported between the processing stations by a conveying device which includes grippers; and executing at least one part of the method in the second group having at least one processing station that is not linearly disposed in line with the first group in the horizontal plane (x, z) in a conveying direction (x) of the bags;

transporting the bags or semi-finished products in a direction lateral to that of the processing direction (z) by a cross traverse of the grippers; and transferring the bags or semi-finished products to a transfer station at which the bags or semi-finished products are grasped, held, and further conveyed.

12. The method according to claim 11, wherein the bags are filled after the step of transporting in a cross traverse.

13. The method according to claim 12, wherein the bags are filled alternatively or sequentially at two filling stations.

14. The method according to claim 12, wherein the bags are filled with dusty materials.

* * * * *